US005124000A

United States Patent [19]

Stenvall

[11] Patent Number: 5,124,000

[45] Date of Patent: Jun. 23, 1992

[54] METHOD OF AND AN ARRANGEMENT FOR PASSING A FIBRE WEB FROM A WIRE THROUGH A PRESS SECTION

[75] Inventor: Jouko Stenvall, Vihtiälä , Finland

[73] Assignee: Oy Tampella AB, Tampere, Finland

[21] Appl. No.: 683,111

[22] Filed: Mar. 25, 1991

Related U.S. Application Data

[63] Continuation of Ser. No. 452,769, Dec. 19, 1989, abandoned.

[30] Foreign Application Priority Data

Dec. 23, 1988 [FI] Finland ..... 885978

[51] Int. Cl.[5] ..... D21F 3/04; D21F 2/00

[52] U.S. Cl. ..... 162/205; 162/306; 162/360.1

[58] Field of Search ..... 162/205, 306, 358, 360.1

[56] References Cited

U.S. PATENT DOCUMENTS

| | | | |
|---|---|---|---|
| 2,415,351 | 2/1947 | Hornbostel et al. | 162/306 |
| 4,086,131 | 4/1978 | Rempel et al. | 162/360.1 |
| 4,483,745 | 11/1984 | Wicks et al. | 162/358 X |
| 4,595,745 | 7/1985 | Cronin | 162/306 |
| 4,681,659 | 7/1987 | Sbaschnigg | 162/358 X |
| 4,792,381 | 12/1988 | Pajula | 162/306 X |
| 4,874,470 | 10/1989 | Skaugen | 162/306 X |

*Primary Examiner*—Karen M. Hastings
*Attorney, Agent, or Firm*—Ladas & Parry

[57] ABSTRACT

A method and an arrangement for passing a fibre web (25) from a wire (3) of a former (1) through a press section (2) including at least three nips (N1, N2, N3) each formed by a pair of press rolls. The method involves transferring the web (25) from the wire (3) onto a sucession of press felts (7) and passing it through the nips (N1, N2, N3) so that it is all the time from the separating point of the web (25) and the wire (3) at least up to the third nip (N3) supported on both sides and in contact with at least one felt (7, 13, 18) acting as a support element. Another support element includes suction zones in various ones of the press rolls for causing air pressure to press the web against the press felt on which it is being conveyed. The arrangement includes press rolls (6, 8, 12, 15, 16) forming at least three nips (N1, N2, N3), and at least one press felt (7, 9, 13, 18) for each nip (N1, N2, N3), and support elements for supporting the web (25) on both sides all the time from the separating point of the web (26) and the wire (3) at least up to the third nip (N3).

2 Claims, 1 Drawing Sheet

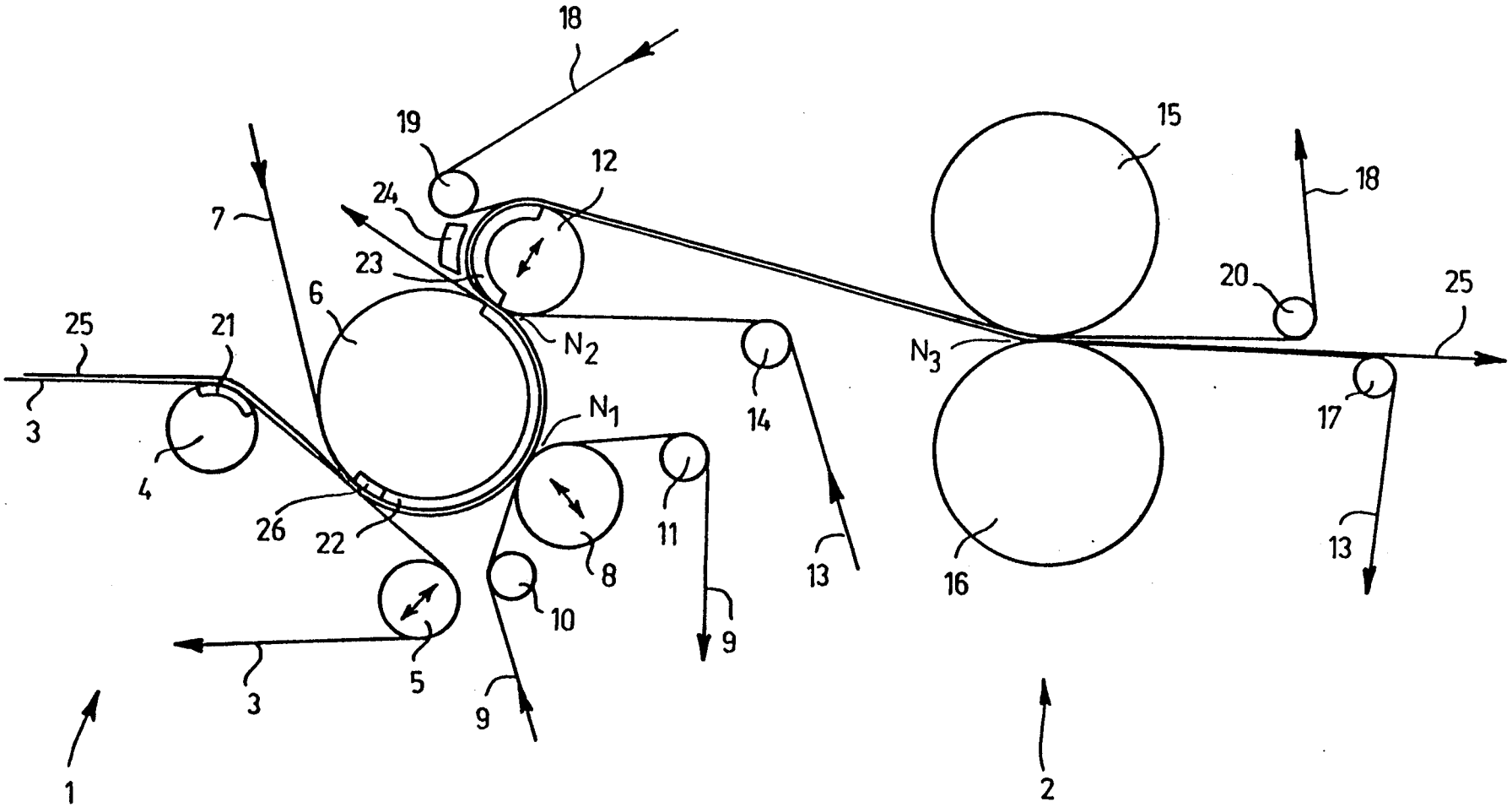
25
18
17
13
20
15
2
16
N3
13
14
9
11
18
12
N2
N1
8
10
9
19
24
23
5
6
22
26
3
7
21
4
25
3
1

METHOD OF AND AN ARRANGEMENT FOR PASSING A FIBRE WEB FROM A WIRE THROUGH A PRESS SECTION

This is a continuation of copending application Ser. No. 07/452,769 filed on Dec. 19, 1988, now abandoned.

The invention relates to a method of passing a fibre web from a wire of a former through a press section comprising at least three nips, comprising transferring the web from the wire onto a first press felt and passing it through the nips of the press section, the web being in constant contact with and supported by at least one press felt all the time from the wire at least up to the third nip.

The invention is also concerned with an arrangement for realizing the method, comprising press rolls forming at least three nips, and at least one press felt for each nip, whereby a web is arranged to be passed from the wire onto the first press felt and at least up to the third nip in constant contact with and supported by one of the press felts at least up to the third nip.

In the production of paper or other similar fibre web, a web is formed first in a former, and then transferred into a press and drying section for removing water from it. Typically, the transfer takes place by passing the web from the wire of the former onto a press felt and then further through the press section. During the transfer, the web is still weak in structure, which frequently results in breaks and resultant production losses. This occurs particularly at the inlet end of the press section when the web is being transferred from the wire onto a felt or from one felt onto another.

U.S. Pat. No. 3,285,806 discloses a solution in which the web is transferred from the wire of the former onto a felt going through a nip and further from the felt after the nip onto another felt. After the second nip the web is passed up to a third nip without any supporting wire or felt. As the web still contains plenty of water, it easily flutters between the second and the third nip and also breaks easily. Further, the web may after the first nip tend to follow the wire on which it was passed through the nip instead of following the press felt on which it is to be passed through the second nip. A further drawback of this solution is that the maximum rate of the machine is limited by the low strength of the web passed from the second nip to the third nip without any support.

European Patent Application 0107606 discloses a solution in which the web is transferred from a wire onto at least one wire or felt to be supported by them all the time when passed through successive nips. Also in this solution the web may come off the felt and begin to flutter, whereby it often breaks, causing stoppages with resultant extra costs.

The object of the present invention is to provide a method of and an arrangement for passing a web from a wire through a press section at least up to a third nip, in which the web is supported all the time so that it will not flutter nor break. The method of the invention is characterized in that when being passed from the wire at least up to the third nip, the web is supported on both sides by at least one support element, one support element being all the time formed by one of the press felts up to at least the third nip.

The arrangement of the invention, in turn, is characterized i that it comprises support elements for supporting the web all the time and on both sides while it is being passed from the separating point of the web and the wire at least up to the third nip, one of the press felts acting as one support element all the time at least up to the third nip.

It is essential in the method that the web is supported all the time from the wire up to the third nip. The web is supported on both sides by means of support elements one of which is always a press felt while the other is either another press felt disposed on the other side of the web or a suction zone or the like effecting a vacuum acting on the web through the first felt. The web is thereby all the time pressed against one of the press felts either between two felts pressed against each other or under the influence of the pressure difference pressing the web against the press felt. The web remains all the time in tight contact with the press felt and will not flutter. At the same time water expelled from the web into the press felt at the nip can be removed from the felt through the suction zone, which eliminates one prior art problem, that is, the rewetting of the web between the nips.

It is essential in the arrangement that it comprises, between the wire and the third nip, support elements supporting the web over its entire length on both sides. One of the support elements is always a press felt or the like and the other is either another press felt disposed on the other side of the web or a suction element such as a suction zone formed in a press roll. The suction zone effects a vacuum acting on the web through the felt. In the arrangement, the web is always supported by two elements, so that water expelled from the web into the press felt at the nip, particularly by the suction elements, can be removed, thus preventing the rewetting phenomenon occurring in prior art solutions.

BRIEF DESCRIPTION OF THE DRAWING

The invention will be described in greater detail in the attached drawing, which shows schematically an arrangement of the invention.

DETAILED DESCRIPTION

The FIGURE shows schematically the terminal end of a former 1 and the inlet end of a press section 2. The former 1 comprises a wire 3 which goes around rolls 4 and 5 at the end of the former and returns then to its inlet end. The first press roll of the press section 2 is a central roll 6 around which a first press felt 7 moves. A second press roll 8 forms a first nip N1 with the central roll 6, and a second press felt 9 going around control rolls 10 and 11 disposed close to the roll 8 extends around the second press roll 8 and through the nip N1. A second nip N2 is formed by the central roll 6 and a third press roll 12, and a third press felt 13 extending around a control roll 14 goes around the third press roll 12 and through the second nip N2. The third press felt 13 further passes through a third nip N3 formed by a fourth and a fifth press roll 15 and 16, being turned after them around a turning roll 19 and downwards. Furthermore, a fourth press felt 18 passes through the third nip N3 after having first turned around the turning roll 19 onto the third press roll 12 so as to extend in parallel with the third press felt 13. The fourth press felt 18 then turns around a control roll 20 positioned after the rolls 15 and 16 and is returned to the control roll 19. The former roll 4 comprises the last suction zone 21 of the former, the central roll 6 comprises a first suction zone 22 in the press section and the third press roll 12, forming the second nip N2, comprises a second suction zone 23 in the press section. A steam box 24 is provided within the area of the suction zone 23.

The web 25 is passed together with the wire 3 onto the roll 4, the suction zone 21 of which sucks water from the web and the wire while keeping the web pressed against the wire 3. The inlet portion of the suction zone 21 may be formed by a separate pick-up zone 26, which transfers the web 25 more reliably. After the web has been passed up to the central roll 6, it is passed between the wire and the felt 7 while the vacuum created by the suction zone 22 of the central roll 6 effects a pressure difference which presses the web 25 against the press felt 7. The web 25 is thereby displaced onto the central roll with the felt 7. The felt 7 supports the first side of the web 25, that is, the side which has faced away from the wire. Due to the vacuum of the suction zone 22, the second side of the web, that is, the side facing away from the felt is pressed by atmospheric pressure. So the web is supported on both sides by the support elements, one of which is the press felt 7 while the other is the pressure difference acting across the web 25, thus pressing it against the press felt 7. At the same time water is absorbed from the web 25 through the felt 7 into the suction zone 22, whereby the dry matter content of the web increases. When the web 25 reaches the first nip N1 formed by the rolls 6 and 8, it comes into contact with the second press felt 9 moving along the surface of the second press roll 8, thus remaining between the press felts 7 and 9. At the nip, water is removed from the web into the press felts 7 and g on its both sides. After the first press nip N1, the press felt 9 is separated from the surface of the web 25 and is further passed on to a conventional dewatering step (not shown) before being returned to the nip. The web 25 is passed on with the felt 7 along the surface of the central roll 6, whereby the suction zone 22, which extends beyond the second nip formed by the rolls 6 and 12, sucks water contained in the felt 7, thus preventing the rewetting of the web 25 while the web is again supported all the time on both sides between the nips N1 and N2.

When the web arrives at the second nip, formed by the rolls 6 and 12, it is passed between the third press felt 13 and the first press felt 7, water being removed from it into both felts. After the second nip, the first press felt 7 is separated from the web and passed to a conventional dewatering step (not shown) before being returned to the roll 6. The web 25, on which the suction zone 23 of the third roll 12 starts to act after the second nip, is displaced onwards with the third press felt 13 along the surface of the roll 12. The suction zone 23 sucks water absorbed into the third press felt 13 while the web 25 is supported in a reverse manner as compared with the preceding steps, that is, the second side is supported by the press felt 13, and the first side is supported by the pressure difference acting across the web towards the press felt. After the second nip N2 the web 25 is passed onwards on the third press felt along the surface of the roll 12, until it is passed between the fourth press felt 18 and the third press felt 13, whereafter it is still passed on a short distance along the surface of the roll 12, being still within the area of the suction zone 23, until the felts 13 and 18 and the web 25 are separated from the surface of the roll 12 and displaced to the third nip formed by the rolls 15 and 16. Between the second and the third nip, the web is supported on both sides by support elements, that is, by the press felt 13 and the suction zone 23 over a distance, and then by the press felts 13 and 18. At the nip formed by the rolls 15 and 16, water is again expelled from the web into the press felts 13 and 18, whereafter the felts are passed to a conventional dewatering treatment, and the web 25 is passed on to subsequent press and drying steps.

The FIGURE shows one preferred embodiment of the invention, in which the web is passed through the nips by means of the central roll 6 acting both as a pick-up roll and a press roll, so that there is no nip or separate pick-up roll at the web transfer point. When the web is passed from the wire through the first nip, water can be removed from it before the nip to some extent, so that when the web reaches the first nip, it is dryer than in prior art solutions. Accordingly, it can be pressed at the first nip with a greater force than in the case of a web passed directly from the wire through the nip. After the first three nips, the dry matter content of the web is considerably greater than in prior art solutions. Moreover, the removal of water from the web in the solution of the FIGURE takes place substantially symmetrically on both sides of the web, so that the resultant web is even in quality and particularly the additives and the fine fibre material contained in the web remain evenly distributed in the direction of the thickness of the web. In addition, the running rate of the machine can be increased due to the greater dry matter content obtained in the first three nips; alternatively, the final drying step can be shorter. Still another advantage of the invention is that as the fibre web is continuously supported on both sides, it will not flutter nor come off the felt at any stage before it is sufficiently dry to resist such strains.

The invention is in no way restricted to the above description or drawing, but it can be effected in various ways. The passage of the different press felts in parallel with the web can be adjusted in various ways. Also, the length and position of the drying zone can vary, provided that the web is all the time supported by two support elements from the wire up to the third nip. The first press zone can be positioned at a point at which the web is separated from the wire, or the web can be separated from the wire with a separate pick-up roll. When the web is passed on substantially linearly, one press felt and a planar suction box pressed against it can be used in place of two felts, provided that the web is all the time supported by two support elements.

I claim:

1. A method of passing a fibre web (25) from a wire (3) of a former (1) through a press section (2) comprising three successive nips (N1, N2, N3), the first and second nips being formed between a central roll (6) and first (8) and second (12) press rolls, respectively, and the third nip being formed between a pair of third (15) and fourth (16) press rolls spaced a distance from said second roll (12), in which method the web is substantially always supported on opposite sides by separate support elements as follows: between the point of separation of the web from the wire (3) and the second nip (N2), supporting a first side of the web by a first press felt (7) which picks up the web from the wire, said first press felt passing around the central roll (6) which acts as a pick up roll, and supporting the opposite side of the web by means of a pressure differential effected by a suction zone (22) within the central roll, the first nip being located downstream from the pick up of the web from the wire; between the second nip and the point of separation of the web from the second press roll (12), supporting the first side of the web by means of a pressure differential effected by a suction zone (23) within the second roll and supporting the opposite side of the web by a second press felt (13) passing around the second press roll and extending between the second press roll and the third nip; and between the point of separation of the web from the second press roll and the third nip, sandwitching the web, for supporting both sides thereof, between said second press felt (13) and a third press felt (18) extending between the third nip and the point of separation of the web from the second press roll.

2. An arrangement for pressing a fibre web conveyed from a web former and transferred to a web press at a point of separation therebetween, said web press comprising a plurality of pairs of press rolls (6–8, 6–12, 15–16), successive pairs of said rolls forming three successive and spaced apart nips (N1, N2, N3), and including at least one press felt (7, 9, 13, 18) for each nip (N1, N2, N3), a first press roll being a central roll (6) around which along its surface is passed a first press felt (7) on which is carried the web (25), said first press felt being located to pick up the web from a wire of the web former, said central roll being located to act as a pick up roll and including a suction zone (22) along the surface thereof around which said first felt is passed, the first felt (7) acting as a support element on a first side of the web (25) at least between the separating point and the first nip (N1) which is located downstream of the pick up of the web from the wire, and the suction zone (22) acting as a support element on the second side of the web (25), which suction zone extends at least between the separating point and the first nip (N1), the first press felt (7) passing along the surface of the central roll (6) up to a second nip (N2) formed by the central roll (6) and a third press roll (12), the first press felt (7) acting as a support element on the first side of the web (25) between the first and the second nip (N1, N2), and the suction zone (22) included in the central roll (6) extending at least up to the second nip (N2) and serving as a support element for the second side of the web (25), a second press felt (13) on the second side of the web (25), the second press felt (13) passing through the second nip (N2) and around the third press roll (12) along its surface, the web (25) contacting the second press felt (13) and being conveyed thereby to a third nip, the second felt serving as a support element on the second side of the web (25) at least between the second and the third nips (N2, N3) the third press roll including a suction zone extending at least from the second nip up to a point on the surface of said third press roll where the second felt separates from said third press roll, said suction zone serving as a support element on the first side of the web, and a third press felt (18) arranged to pass in contact with the first side of the web (25) at least from the end of the second suction zone (23) up to a third nip (N3) and further arranged to act as a support element for the first side of the web (25) at least over this distance, whereby the web is substantially always supported on both sides thereof during its passage from said first to said third nip.

* * * * *